US010145384B2

(12) United States Patent
Liao et al.

(10) Patent No.: US 10,145,384 B2
(45) Date of Patent: Dec. 4, 2018

(54) ENGAGEMENT FAN

(71) Applicant: Quanta Computer Inc., Tao Yuan Shien (TW)

(72) Inventors: Ting-Huei Liao, Taoyuan (TW); Feng-Lin Hsu, Taoyuan (TW); Hui-Chi Hsu, Taoyuan (TW)

(73) Assignee: QUANTA COMPUTER INC., Tao Yuan Shien (TW)

( * ) Notice: Subject to any disclaimer, the term of this patent is extended or adjusted under 35 U.S.C. 154(b) by 416 days.

(21) Appl. No.: 15/176,024

(22) Filed: Jun. 7, 2016

(65) Prior Publication Data

US 2017/0268531 A1 Sep. 21, 2017

(30) Foreign Application Priority Data

Mar. 16, 2016 (TW) ..... 105108079 A

(51) Int. Cl.
*F04D 29/42* (2006.01)
*F04D 29/02* (2006.01)
*F04D 29/62* (2006.01)

(52) U.S. Cl.
CPC ..... *F04D 29/4226* (2013.01); *F04D 29/626* (2013.01); *F04D 29/023* (2013.01)

(58) Field of Classification Search
CPC ... F04D 29/023; F04D 29/4226; F04D 29/626
See application file for complete search history.

(56) References Cited

U.S. PATENT DOCUMENTS 6,343,011 B1 * 1/2002 Yu ..... G06F 1/181 165/104.33
7,473,074 B2 * 1/2009 Herbst ..... F04D 29/023 415/116
7,861,708 B1 * 1/2011 Lyons ..... F04D 29/668 126/104 A
7,909,571 B2 * 3/2011 Wu ..... F04D 29/4213 415/206
8,072,101 B2 * 12/2011 Ho ..... F04D 25/0613 310/268
8,133,006 B2 3/2012 Yoshida
8,360,719 B2 * 1/2013 Huang ..... F04D 29/526 415/208.1
8,585,362 B2 11/2013 Horng
(Continued)

FOREIGN PATENT DOCUMENTS

JP 8-127221 A 5/1996
TW 201109533 A 3/2011

OTHER PUBLICATIONS

Office Action issued in corresponding Taiwan patent application dated Dec. 9, 2016.

*Primary Examiner* — Igor Kershteyn
(74) *Attorney, Agent, or Firm* — McClure, Qualey & Rodack, LLP

(57) ABSTRACT

An engagement fan includes a fan base, a cover plate and a fan base plate. The fan base has an opening at the bottom surface thereof. The rim of the opening is disposed with at least one engagement slot and at least one restricting protrusion. The cover plate covers the fan base. The engagement protrusion engages to the corresponding engagement slot such that the fan base plate can be attached to the opening of the fan base.

9 Claims, 6 Drawing Sheets

(56) References Cited

U.S. PATENT DOCUMENTS

| | | | | |
|---|---|---|---|---|
| 2003/0180144 | A1* | 9/2003 | Lee | F04D 17/08 415/204 |
| 2009/0067991 | A1* | 3/2009 | Hwang | F04D 25/0613 415/119 |
| 2011/0058938 | A1* | 3/2011 | Chen | F04D 29/4226 415/206 |

* cited by examiner

ENGAGEMENT FAN

CROSS-REFERENCE TO RELATED APPLICATION

This application claims priority from Taiwan Patent Application No. 105108079, filed on Mar. 16, 2016, in the Taiwan Intellectual Property Office, the content of which is hereby incorporated by reference in its entirety for all purposes.

BACKGROUND OF THE INVENTION

1. Field of the Invention

The present invention is related to a fan. More specifically, the present invention is related to an engagement fan in which the fan base plate having a fan is able to engage the opening of the fan base.

2. Description of the Related Art

Most of the time, modifications have to be made to the housings of fans having similar fan size due to the difference in the exterior design or internal structure of the device that the fan will be installed to.

The housing of the fan can be divided into three major parts, i.e. the base, the frame and the top cover. When the fan housing is to be modified, the three major parts have to be individually remolded, i.e. the moldings for the base, the frame and the top cover have to be remade.

It is evident that, despite the fans are similar in size, the moldings have to be remade to produce corresponding housings due to the difference in exterior design or internal structure of the device that the fan will be installed to; such situation will cause the rise in production cost as well as lower the versatility of the component.

SUMMARY OF THE INVENTION

In light of the aforementioned technical issues, the objective of the present invention is to provide an engagement fan as the solution for such issues.

According to the objective of the present invention, an engagement fan is provided. The engagement fan includes a fan base, a cover plate and a fan base plate. The fan base has an opening at a bottom surface thereof. The rim of the opening is disposed with at least one engagement slot and at least one restricting protrusion. The cover plate covers the fan base. The accommodation space is formed between the cover plate and the fan base. The fan base plate is engaged to the opening of the fan base. The side of the fan base plate corresponding to the accommodation space is disposed with a fan. The fan base plate includes at least one positioning dent and at least one engagement protrusion. When the at least one positioning dent passes through the corresponding at least one restricting protrusion, the fan base plate is turned such that the at least one engagement protrusion engages the corresponding at least one engagement slot.

Preferably, the at least one engagement slot includes a sliding slot and an engagement dent, when the at least one positioning dent passes through the corresponding at least one restricting protrusion, the at least one engagement protrusion is inside the sliding slot of the corresponding at least one engagement slot and moves along the sliding slot to the engagement dent.

Preferably, the quantity of the engagement slot corresponds to the quantity of the engagement protrusion.

Preferably, when there are a plurality of engagement slots and a plurality of engagement protrusions, positions of the plurality of engagement slots correspond to positions of the plurality of engagement protrusions.

Preferably, the quantity of the restricting protrusion corresponds to the quantity of the positioning dent.

Preferably, when there are a plurality of restricting protrusions and a plurality of positioning dents, the positions of the plurality of restricting protrusions correspond to the positions of the plurality of positioning dents.

Preferably, the fan base is a plastic base.

Preferably, the cover plate is a metal cover.

Preferably, the fan base plate is a metal base plate.

In conclusion, since the structural specification of the fan base plate in the engagement fan of the present invention is fixed, nothing but the structural specification of the fan base and the cover plate require modification when the fan is applied to device with different structures, therefore the development cost of the fan can be lowered, the production cycle can be shortened and the versatility of the fan can be improved.

DESCRIPTION OF THE PREFERRED EMBODIMENTS

Figure 1:
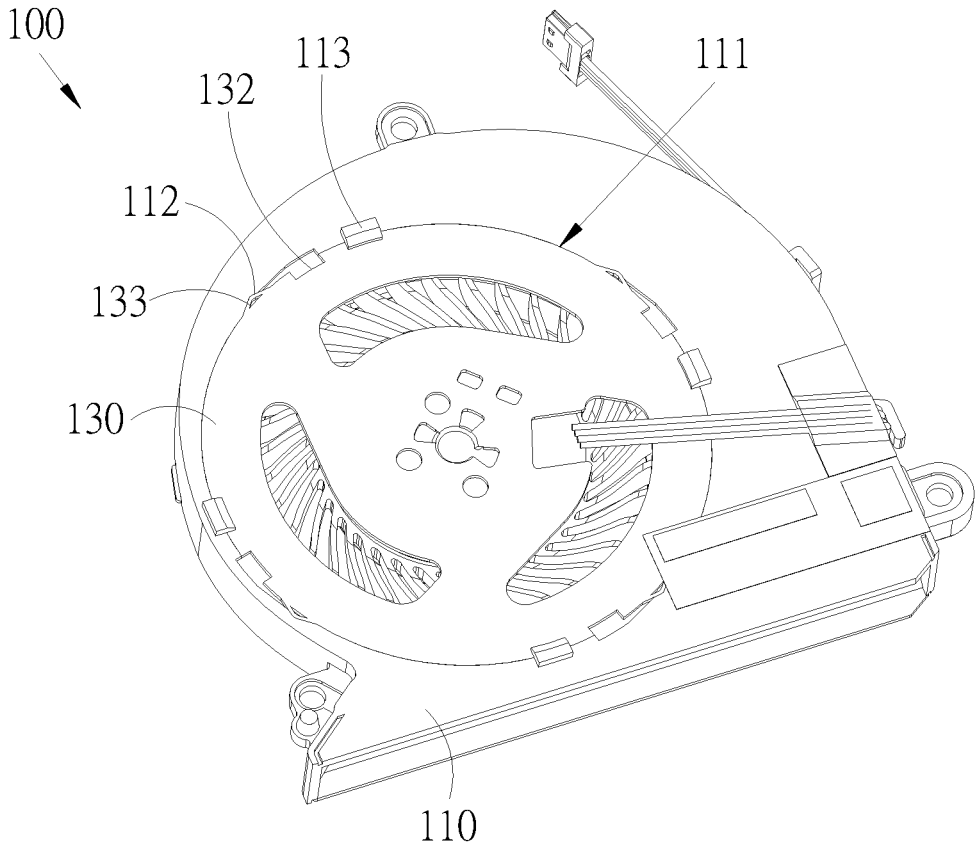
FIG. 1 is the schematic diagram illustrating the engagement fan of the present invention.

Various aspects such as the technical features, advantages or content of the present invention will be set forth in detail in the form of preferred embodiments hereinafter, and the description will be made along with reference to the attached drawings, which are solely illustrative and serve to provide better understanding of the present invention only, the scale and/or proportion of any portion of the drawing do not represent the actual configuration of the invention, hence the scale, proportion or shape in the drawings should not be misconstrued as limiting the scope of the invention.

Hereinafter, embodiments of the present disclosure will be described in detail with reference to the accompanying drawings so that those skilled in the art to which the present disclosure pertains can realize the present disclosure. As those skilled in the art would realize, the described embodiments may be modified in various different ways, all without departing from the spirit or scope of the present disclosure.

Figure 2:
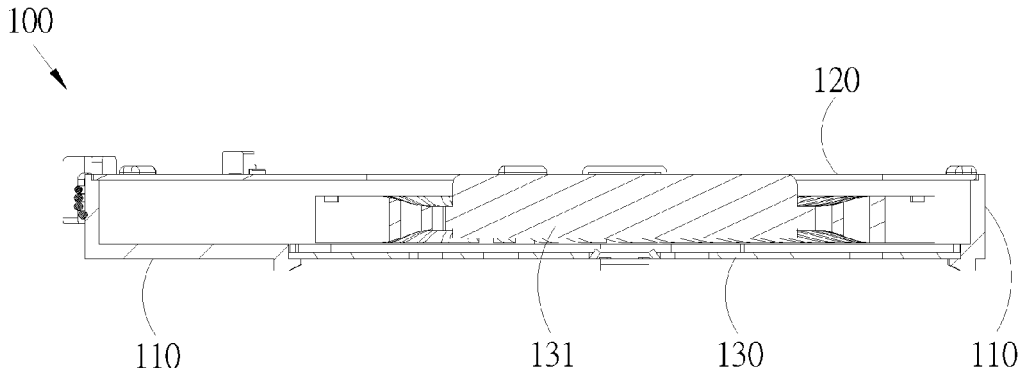
FIG. 2 is the sectional view of the engagement fan of the present invention.

FIGS. 1 and 2 are respectively the schematic diagram and the sectional view illustrating the engagement fan of the present invention. As shown in the drawings, the engagement fan 100 of the present invention includes a fan base 110, a cover plate 120 and a fan base plate 130. The fan base plate 130 facing the cover plate 120 is engaged to the opening 111 formed at the fan base 110.

The bottom surface of the fan base 110 is disposed with the opening 111; the rim of the opening 111 is disposed with at least one engagement slot 112 and at least one restricting protrusion 113. The cover plate 120 is configured to cover the fan base 110; an accommodation space is formed between the cover plate 120 and the fan base 110 to accommodate the fan 131. The fan base plate 130 is configured to engage to the opening 111 of the fan base 110; the fan 131 is disposed at the side of the fan base plate 130 facing to the accommodation space. The fan base plate 130 includes at least one positioning dent 132 and at least one engagement protrusion 133. After the positioning dent 132 has passed through the corresponding restricting protrusion 113, the fan base plate 130 can be turned such that the engagement protrusion 133 engages the corresponding engagement slot 112.

More specifically, after the fan base plate 130 is turned, the position of the positioning dent 132 will shifted away from the position of the restricting protrusion 113, so the rim of the fan base plate 130 will correspond to the position of the restricting protrusion 113; since the rim of the fan base plate 130 is not dented, the rim of the fan base plate 130 will overlap with the restricting protrusion 113, i.e. the rim of the fan base plate 130 will be positioned between the restricting protrusion 113 and the cover plate 120. As a result the restricting protrusion 113 is capable of restricting the position of the fan base plate 130 so as to prevent the fan base plate 130 from falling off the opening 111.

Figure 3:
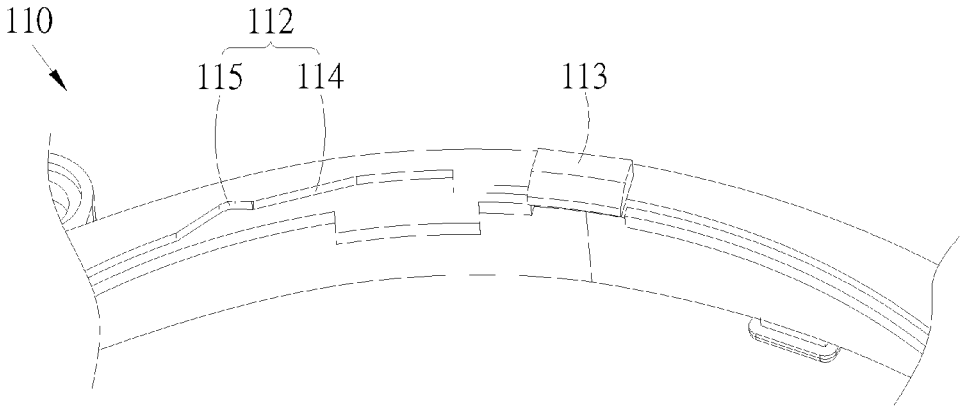
FIG. 3 is the partial schematic diagram illustrating the fan base of the engagement fan of the present invention.
Figure 4:
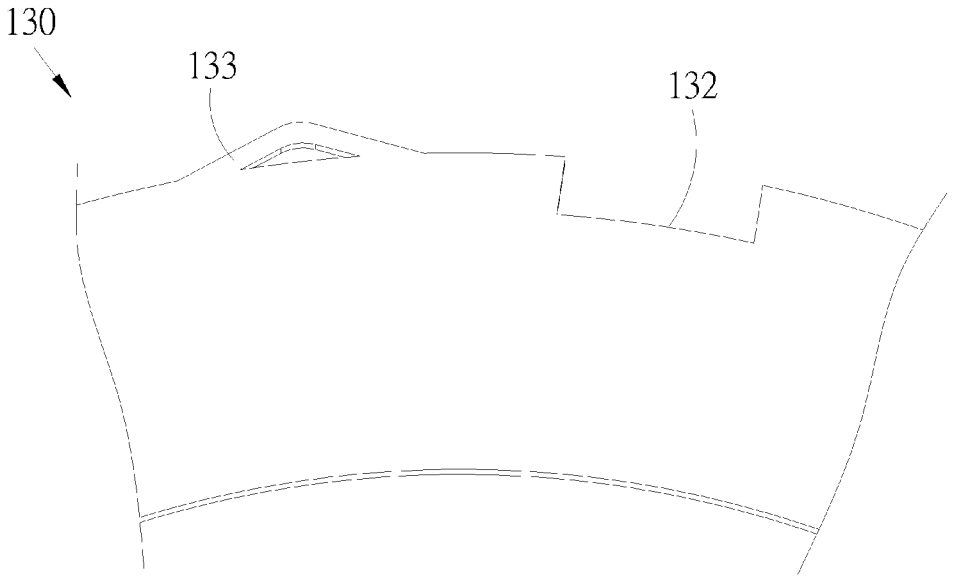
FIG. 4 is the partial schematic diagram illustrating the fan base plate of the engagement fan of the present invention.
Figure 5:
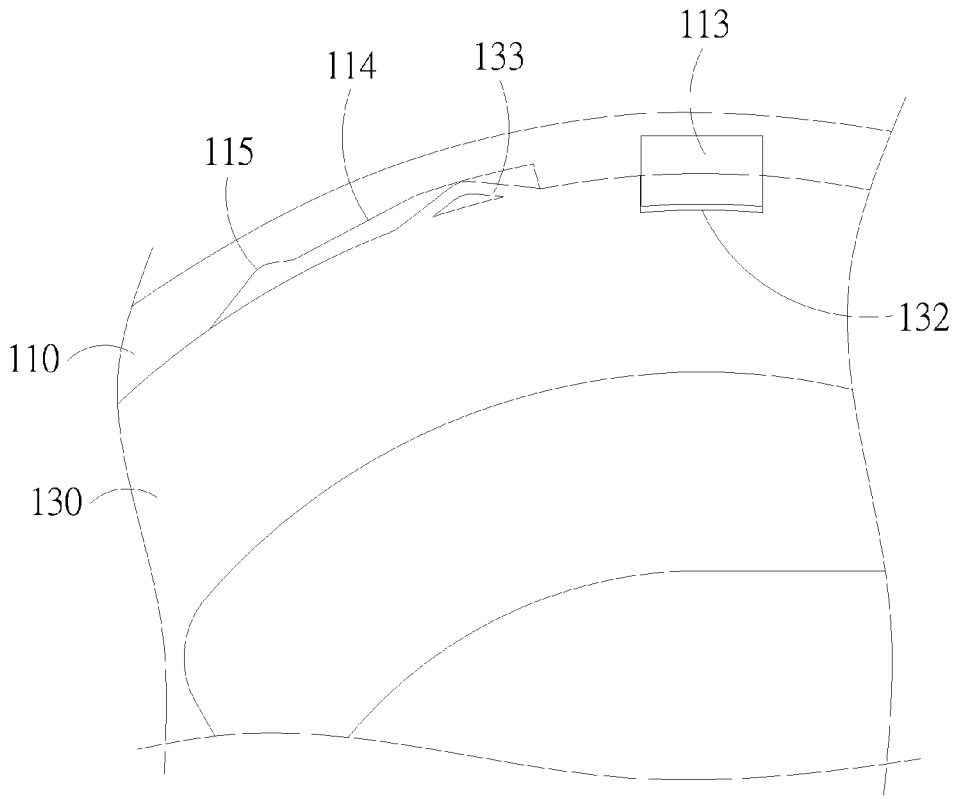
FIG. 5 is the first partial schematic diagram of the engagement fan of the present invention.
Figure 6:
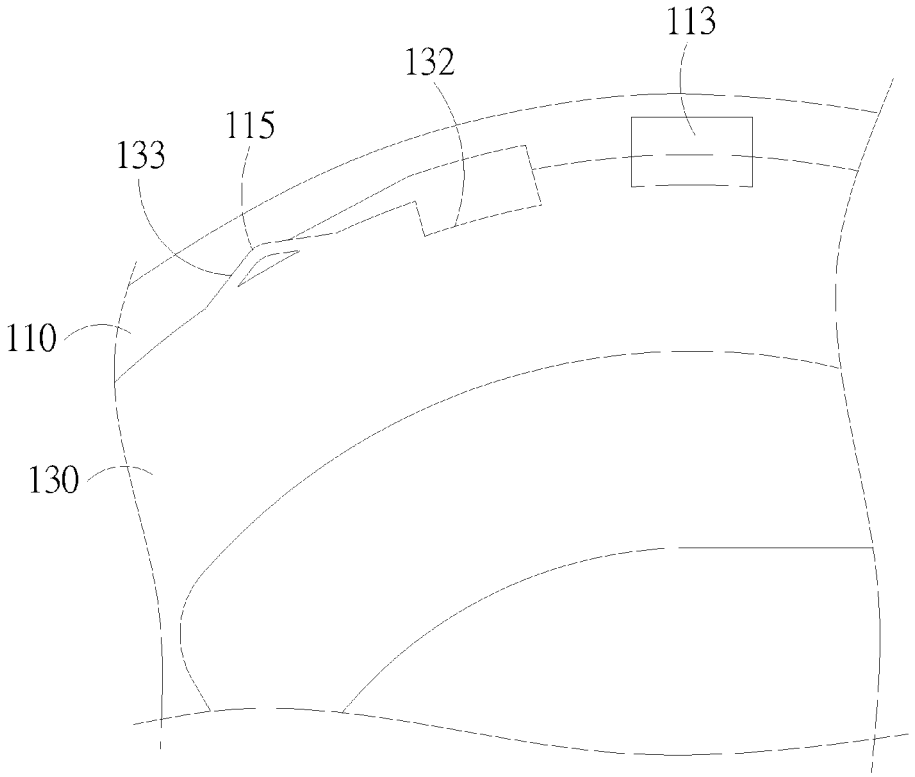
FIG. 6 is the second partial schematic diagram of the engagement fan of the present invention.

Reference will be made to FIGS. 3 to 6 herein. FIG. 3 is the partial schematic diagram illustrating the fan base of the engagement fan of the present invention. FIG. 4 is the partial schematic diagram illustrating the fan base plate of the engagement fan of the present invention. FIG. 5 is the first partial schematic diagram of the engagement fan of the present invention. FIG. 6 is the second partial schematic diagram of the engagement fan of the present invention. As shown in the drawings, the engagement slot 112 of the opening 111 of the fan base 110 may include a sliding slot 114 and an engagement dent 115. So when the positioning dent 132 passes through the corresponding restricting protrusion 113 as illustrated before, the engagement protrusion 133 will be situated in the sliding slot 114 of the corresponding engagement slot 112, once the fan base plate 130 is turned as shown in FIG. 6, the engagement protrusion 133 is configured to move along the sliding slot 114 to the engagement dent 115 and engages therewith.

In order to make the installation more convenient, in a preferred embodiment, the quantity of the engagement slot 112 corresponds to the quantity of the engagement protrusion 133. Moreover, when there are a plurality of engagement slots 112 and a plurality of engagement protrusions 133, the positions of the plurality of engagement slots 112 correspond to the positions of the plurality of engagement protrusions 133, i.e. each engagement slot 112 at the opening 111 is disposed at a position corresponding to the position of each engagement protrusion 133 of the fan base plate 130, such that all engagement protrusions 133 are able to engage to the corresponding engagement slot 112 when the fan base plate 130 is being engaged to the fan base 110.

Similarly, the quantity of the restricting protrusion 113 may preferably correspond to the quantity of the positioning dent 132. Furthermore, when there are a plurality of restricting protrusions 113 and a plurality of positioning dents 132, the positions of the plurality of restricting protrusions 113 correspond to the positions of the plurality of positioning dents 132, i.e. each restricting protrusion 113 of the opening 111 is disposed at the position corresponding to the position of each positioning dent 132 of the fan base plate 130, such that each positioning dent 132 can be successfully aligned to the corresponding restricting protrusion 113 during engagement and the fan base plate 130 is able to engage to the opening 111 of the fan base 110, and subsequently the fan base plate 130 is turned so that a firm attachment can be achieved.

It is noteworthy that preferably, the aforementioned fan base 110 may be manufactured via plastic injection, i.e. the fan base 110 may be a plastic base; the cover plate 120 is preferably made from metal, i.e. the cover plate 120 is preferably a metal cover plate; the fan base plate 130 may be made from metal similar to the cover plate 120, i.e. the fan base plate 130 is preferably a metal base plate.

In conclusion, since the structural specification of the fan base plate in the engagement fan of the present invention is fixed, nothing but the structural specification of the fan base and the cover plate require modification when the fan is applied to device with different structures, therefore the development cost of the fan can be lowered, the production cycle can be shortened and the versatility of the fan can be improved.

The present invention has been described with some preferred embodiments thereof and it is understood that many changes and modifications in the described embodiments can be carried out without departing from the scope and the spirit of the invention that is intended to be limited only by the appended claims.

What is claimed is:

1. An engagement fan, comprising:

a fan base having an opening at a bottom surface thereof, a rim of the opening being disposed with at least one engagement slot and at least one restricting protrusion;

a cover plate covering the fan base, an accommodation space being formed between the cover plate and the fan base; and a fan base plate engaged to the opening of the fan base, wherein a side of the fan base plate corresponding to the accommodation space is disposed with a fan, the fan base plate comprises at least one positioning dent and at least one engagement protrusion, when the at least one positioning dent passes through the corresponding at least one restricting protrusion, the fan base plate is turned such that the at least one engagement protrusion engages the corresponding at least one engagement slot.

2. The engagement fan of claim 1, wherein the at least one engagement slot comprises a sliding slot and an engagement dent, when the at least one positioning dent passes through the corresponding at least one restricting protrusion, the at least one engagement protrusion is inside the sliding slot of the corresponding at least one engagement slot and moves along the sliding slot to the engagement dent.

3. The engagement fan of claim 1, wherein a quantity of the at least one engagement slot corresponds to a quantity of the at least one engagement protrusion.

4. The engagement fan of claim 1, wherein when there are a plurality of the engagement slots and a plurality of the engagement protrusions, positions of the plurality of engagement slots correspond to positions of the plurality of engagement protrusions.

5. The engagement fan of claim 1, wherein a quantity of the at least one restricting protrusion corresponds to a quantity of the at least one positioning dent.

6. The engagement fan of claim 1, wherein when there are a plurality of the restricting protrusions and a plurality of the positioning dents, positions of the plurality of restricting protrusions correspond to positions of the plurality of positioning dents.

7. The engagement fan of claim 1, wherein the fan base is a plastic base.

8. The engagement fan of claim 1, wherein the cover plate is a metal cover.

9. The engagement fan of claim 1, wherein the fan base plate is a metal base plate.

* * * * *